US006963056B1

(12) United States Patent
Peysakhovich et al.

(10) Patent No.: US 6,963,056 B1
(45) Date of Patent: Nov. 8, 2005

(54) INDUCTION HEATING OF A WORKPIECE

(75) Inventors: Vitaly A. Peysakhovich, Moorestown, NJ (US); Jean Lovens, Embourg (BE); Michel Fontaine, Aywaille (BE); Peter Robert Dickson, Flint, MI (US)

(73) Assignee: Inductotherm Corp., Rancocas, NJ (US)

( * ) Notice: Subject to any disclaimer, the term of this patent is extended or adjusted under 35 U.S.C. 154(b) by 0 days.

(21) Appl. No.: 10/827,700

(22) Filed: Apr. 20, 2004

Related U.S. Application Data

(60) Provisional application No. 60/469,539, filed on May 9, 2003.

(51) Int. Cl.[7] ..... H05B 6/10; H05B 6/40

(52) U.S. Cl. ..... 219/645; 219/671; 219/672; 219/673

(58) Field of Search ..... 219/645, 646, 219/635, 636, 660–663, 656, 671–673

(56) References Cited

U.S. PATENT DOCUMENTS 4,755,648 A * 7/1988 Sawa ..... 219/661
5,156,683 A * 10/1992 Ross ..... 219/645
5,495,094 A * 2/1996 Rowan et al. ..... 219/645
5,837,976 A * 11/1998 Loveless et al. ..... 219/645
6,043,471 A * 3/2000 Wiseman et al. ..... 219/662

* cited by examiner

*Primary Examiner*—Philip H. Leung
(74) *Attorney, Agent, or Firm*—Philip O. Post

(57) ABSTRACT

An apparatus and process are provided for controlling the cross sectional temperature profile of a continuously moving workpiece with an induction coil assembly that provides for a combination of longitudinal and transverse magnetic flux field heating of the workpiece. The induction coil assembly includes means for laterally moving the workpiece in and out of the coil assembly without movement of the coil assembly.

12 Claims, 3 Drawing Sheets

INDUCTION HEATING OF A WORKPIECE

CROSS REFERENCE TO RELATED APPLICATIONS

This application claims the benefit of U.S. Provisional Application No. 60/469,539 filed May 9, 2003, hereby incorporated herein by reference.

FIELD OF THE INVENTION

The present invention generally relates to magnetic induction heating of a workpiece, and in particular, to induction heating of a workpiece moving through an induction heating coil assembly.

BACKGROUND OF THE INVENTION

The induction coil through which a moving workpiece is heated by magnetic induction is typically configured as a longitudinal flux inductor or transverse flux inductor. The workpiece may be a continuous, electrically conductive strip that passes through the induction coil. A longitudinal flux inductor is generally described as a solenoidal coil that surrounds the strip. AC current flowing through the solenoidal coil produces a magnetic field that is parallel with the longitudinal axis of the strip in regions where the field penetrates the strip. The magnetic field induces eddy currents in the continuously moving strip that heat the strip. A longitudinal flux inductor is superior to a transverse flux inductor for uniform cross sectional heating of a strip. However, when a longitudinal flux inductor is used to inductively heat a thin strip, a high frequency power supply, with attendant cost penalty, is required. Further the solenoidal configuration of a conventional longitudinal flux inductor makes it impossible to laterally move the continuous strip out from within the coil as may be desired, for example, to replace the existing inductor with a new inductor. The continuous strip must be cut to accomplish a change in inductors.

A transverse flux inductor can be used to inductively heat a thin strip at lower frequencies than those used with a longitudinal flux inductor. A transverse flux inductor is generally described as a pair of coils wherein the strip moves in a plane positioned between the planes in which the pair of coils are located. AC current flowing through the coils produces a magnetic field between the pair of coils that penetrates the strip and inductively heats it. Field penetration is generally orthogonal to the surface of the strip. Consequently the induced eddy currents are circulated in a plane near the surface of the strip, but not throughout the width or thickness of the strip. An additional advantage of a transverse flux inductor over a longitudinal flux inductor is that its configuration allows for lateral removal of a continuous strip from between the pair of coils.

In some applications, uniform cross sectional heating of the strip is not desired since the edges will cool down faster than the interior of the strip. For example, in a galvannealing process, a continuously moving strip is dipped into a liquid coating bath. The liquid coating thermally bonds with the strip after exiting from the bath. Since the edges of the strip will cool faster than the central region of the strip, the degree of bonding at the edges may vary to produce an unsatisfactory grade of galvanized product. In such cases, the edges must be scrapped from the galvanized strip product. Various types of dedicated edge heaters have been used to compensate for edge heat losses in a strip. U.S. Pat. No. 5,156,683 discloses a dedicated induction edge heater. The edge heater is preferably of the channel type, and requires the use of a mechanical drive system to reposition the edge heater as the width of the strip changes. Also a continuous strip will laterally oscillate as it moves along the heating line, so the mechanical drive system must be used to adjust the position of the edge heaters to accommodate this lateral motion. Further, in order to allow lateral removal of a continuous strip, the mechanical drive system must move at least one of the edge heaters away from the plane of the strip.

U.S. Pat. No. 5,837,976 discloses a coil system that allows lateral movement of a continuous strip similar to that provided by a transverse flux inductor while providing the advantages of a longitudinal magnetic flux field. The disclosed coil system comprises upper and lower coil sections that, together, form a two-turn solenoidal coil. AC current flowing through the coil sections results in a longitudinal flux field while a gap between the vertical bars or shunts connecting the two coil sections in series permits lateral movement of the strip out from the coil system.

It is one object of the present invention to provide a means for inductively heating a continuously moving workpiece, such as a strip, that allows for controlled edge heating of the strip without movement of the induction heating coils for strips of varied widths, while allowing unrestricted lateral removal of the continuous strip from within the induction heating coil assembly.

BRIEF SUMMARY OF THE INVENTION

In one aspect, the present invention is an apparatus for, and method of, inductively heating a strip moving through an induction coil assembly wherein the induction coil assembly comprises a first coil assembly and a second coil assembly. The first coil assembly is arranged and supplied with ac current to produce a substantially longitudinal magnetic flux field that inductively heats the strip uniformly across its cross section as it passes through the first coil assembly. The second coil assembly is arranged and supplied with ac current to produce a substantially transverse magnetic flux field that inductively heats the strip non-uniformly across its cross section as it passes through the second coil assembly. One example of this aspect of the invention is shown in FIG. 1. The control of the first and second coil assemblies are cooperatively arranged to provide a selective cross sectional heating profile of the strip as it passes through the induction coil assembly.

In another aspect, the present invention is an apparatus for, and method of, inductively heating a strip moving through an induction coil assembly wherein the induction coil assembly comprises upper and lower coil sections through which the strip moves (see e.g. FIG. 2). AC current is supplied to the upper and lower coil sections by two high frequency inverters and one low frequency inverter that are connected to the upper and lower coil sections by a network of inductive and capacitive circuit elements (see e.g. FIG. 3). The high frequency inverters are arranged to supply a high frequency ac current to the induction coil assembly to create a longitudinal flux magnetic field that inductively heats the strip uniformly across its cross section as it passes through the induction coil assembly. The low frequency inverter is arranged to effectively supply a low frequency ac current to the coil assembly to create a transverse flux magnetic field that inductively heats the strip non-uniformly across its cross section as it passes through the induction coil assembly. An interconnecting network of impedances between the ac outputs of the inverters and the terminals of the induction coil assembly allows the flow of low and high frequency currents through the induction coil assembly, and blocks low frequency current flow to the ac output terminals of the high frequency inverters, and blocks high frequency current flow to the ac output terminals of the low frequency inverter.

Other aspects of the invention are set forth in this specification.

BRIEF DESCRIPTION OF THE DRAWINGS

For the purpose of illustrating the invention, there is shown in the drawings a form that is presently preferred; it being understood, however, that this invention is not limited to the precise arrangements and instrumentalities shown.

DETAILED DESCRIPTION OF THE INVENTION

Figure 1:
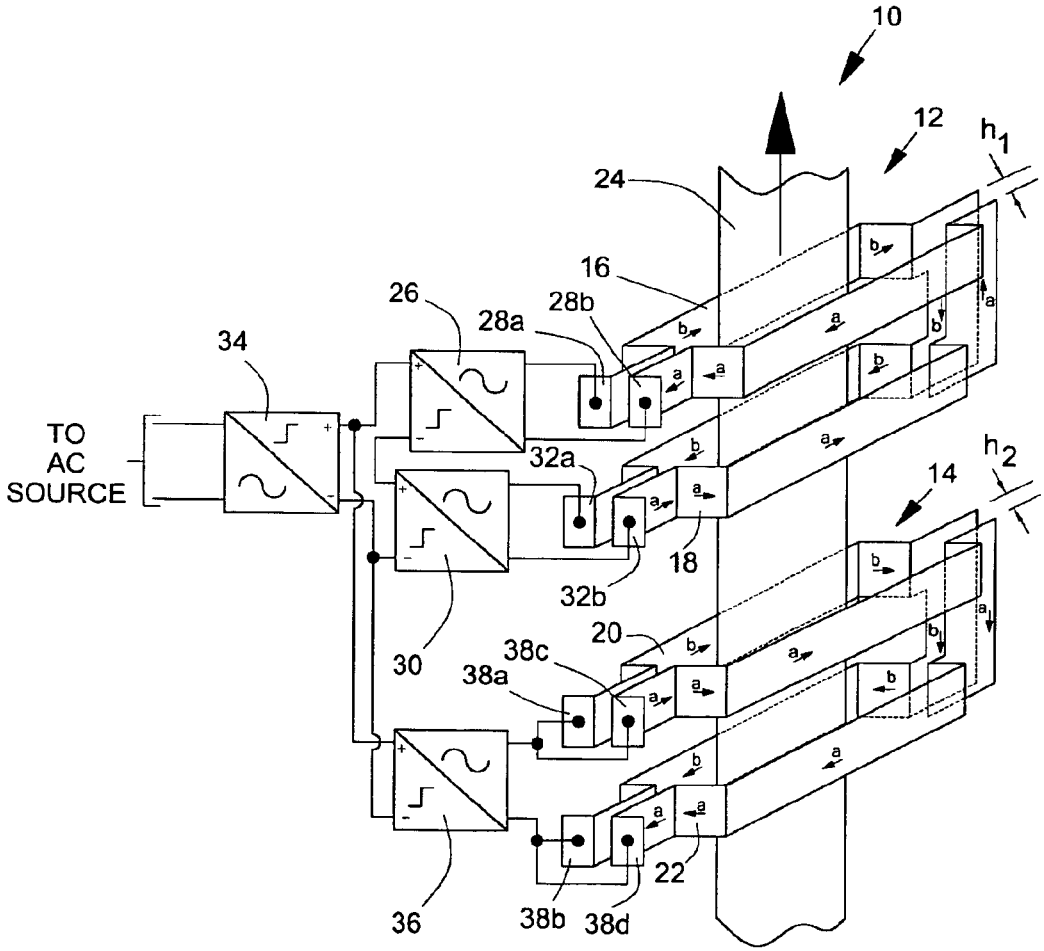
FIG. 1 is a diagrammatic view of one example of an apparatus of the present invention for induction heating of a workpiece.

Referring now to the drawings, wherein like numerals indicate like elements, there is shown in the FIG. 1, one example of the induction heating coil assembly 10 of the present invention. Induction heating coil assembly 10 comprises first coil assembly 12 and second coil assembly 14. First coil subassembly 12 comprises upper coil section 16 and lower coil section 18 as disclosed in U.S. Pat. No. 5,837,976, which is incorporated herein in its entirety. Gap $h_1$ separates first coil assembly 12 into two parts and allows workpiece 24 to be laterally removed from within the coil. A non-limiting configuration of the workpiece is an electrically conductive strip. Second coil assembly 14 comprises a first coil 20 and second coil 22 which form a coil pair on opposing sides of workpiece 24. Gap $h_2$ separates the first and second coils and allows the strip to be laterally removed from within the pair of coils. In this non-limiting example, the strip moves sequentially through the second coil assembly and first coil assembly in the direction indicated by the arrow. In other examples of the invention movement may be sequentially through the first coil assembly and then the second coil assembly.

First inverter 26 supplies single phase ac power to terminals 28*a* and 28*b* of upper coil section 16. Second inverter 30 supplies single phase ac power to terminals 32*a* and 32*b* of lower coil section 18. A common first rectifier 34 supplies dc power from a suitable ac source, such as utility power, to both the first and second inverters. The dc inputs to inverters 26 and 30 are arranged in series as shown in FIG. 1 so that approximately one-half of the dc output voltage of the rectifier is applied equally across the inputs of each of the first and second inverters. AC currents from the first and second inverters to the upper and lower coil sections, respectively, are of substantially equal magnitudes and 180 electrical degrees out of phase to establish substantially equal magnitude current flows a and b, as indicated by the arrows in FIG. 1, through the coil sections. These current flows create a longitudinal magnetic flux field that achieves substantially uniform cross sectional induction heating of the strip.

Third inverter 36 supplies single phase ac power to first and second coils 20 and 22 that form the coil pair of the second coil assembly. The first output of third inverter 36 is connected to terminals 38*a* and 38*c* of the coil pair, and the second output of the third inverter is connected to terminals 38*b* and 38*d* of the coil pair. The ac current supplied from third inverter 36 to coils 20 and 22 are substantially equal magnitude currents a and b, as indicated by the arrows in FIG. 1, through the coil pair. These current flows create a transverse magnetic flux field around the coil pair that can be used to control the induction heating of the edges of strip 24. In this example of the invention, first rectifier 34 also supplies dc power to third inverter 36. In other examples of the invention, a separate rectifier may be provided for supplying dc power to the third inverter.

With this arrangement, substantial control of the overall cross sectional temperature of the continuous strip as it exits induction heating coil assembly 10 can be accomplished by controlling the current outputs of first and second inverters 26 and 30, and temperature at the edges of the strip, relative to the temperature at the central region of the strip, can be accomplished by controlling the current output of third inverter 36.

The above example of the invention utilizes a first coil assembly 12 as disclosed in U.S. Pat. No. 5,837,976 to produce a longitudinal magnetic flux field for uniform cross sectional heating of workpiece 24. In other examples of invention, first coil assembly 12 may comprise other types of coil arrangements that produce a longitudinal magnetic flux field for uniform cross sectional heating of the workpiece.

Figure 2:
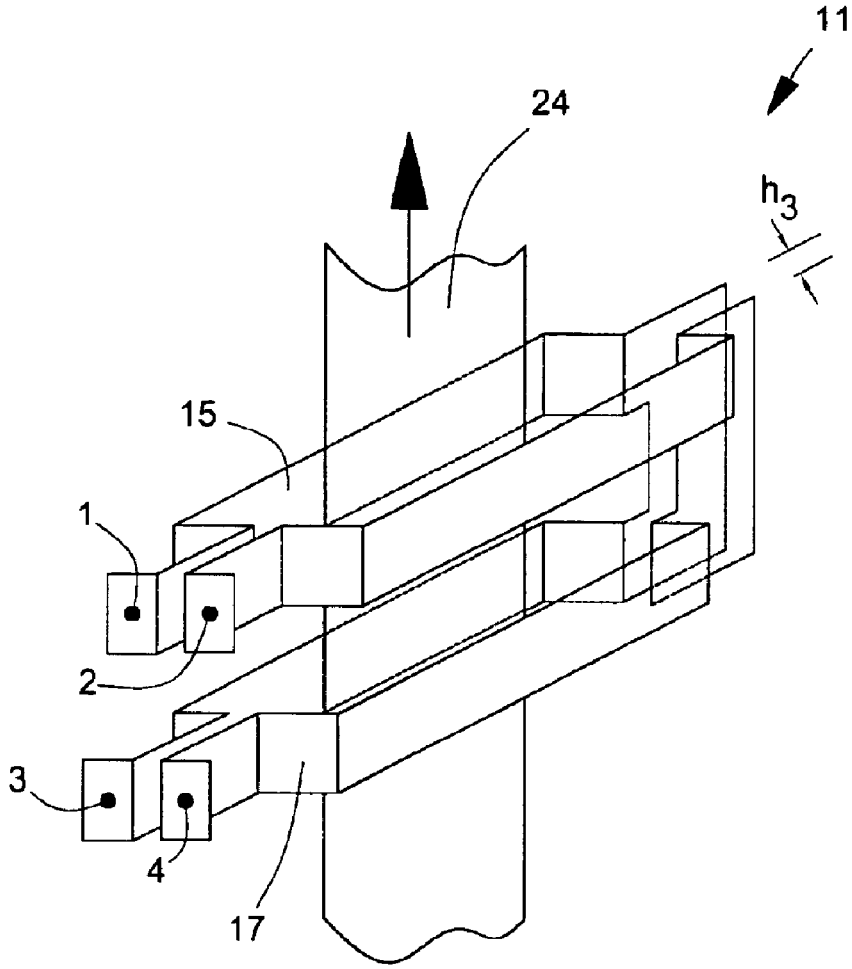
FIG. 2 is an isometric view illustrating one example of an arrangement of an induction coil assembly used with an apparatus of the present invention for induction heating of a workpiece.
Figure 3:
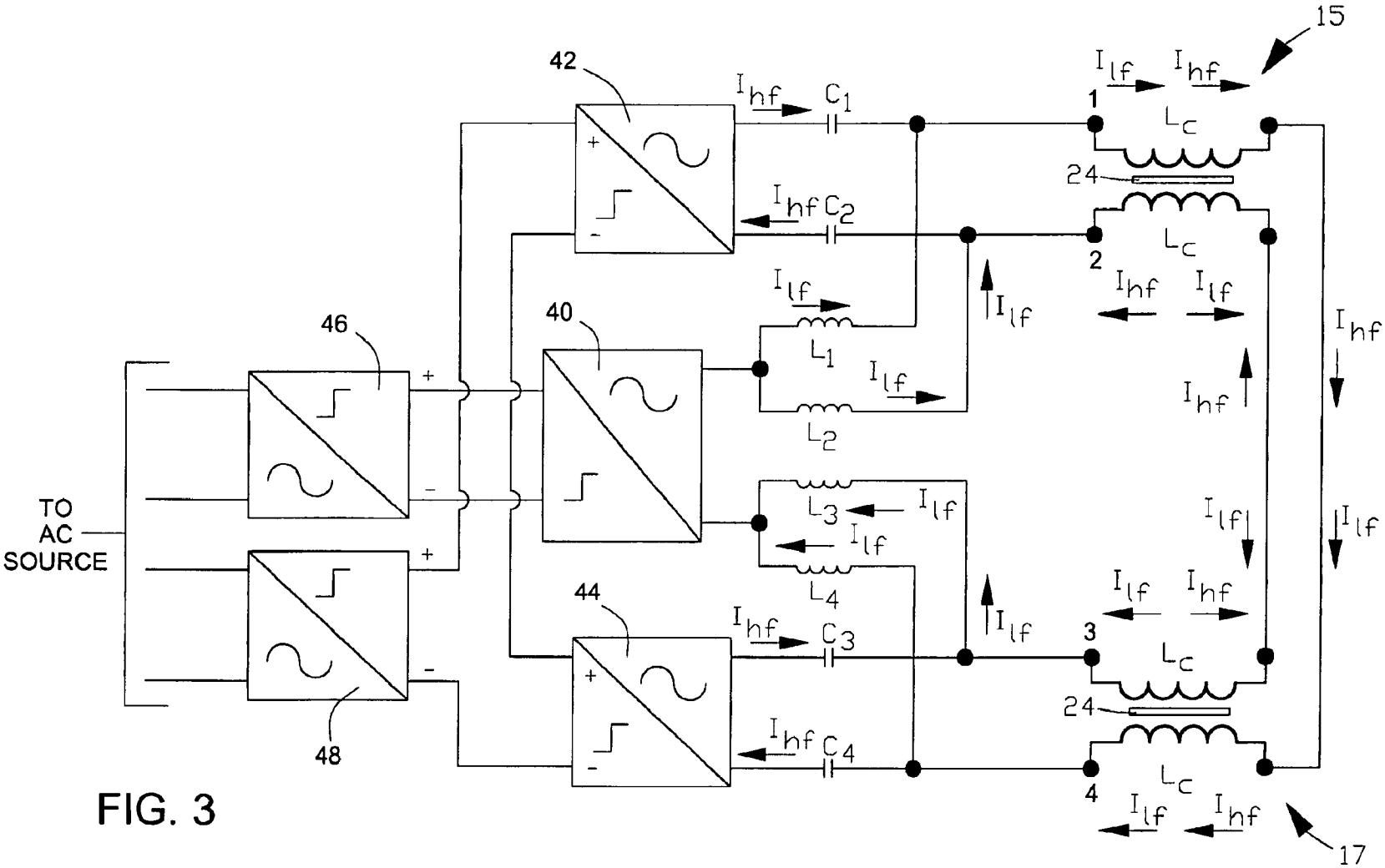
FIG. 3 is a diagrammatic view of one example of a power circuit for use with the induction coils illustrated in FIG. 2.

In some processing lines, the line length available for an induction coil assembly is limited. This is particularly the case in retrofit of existing processing lines. The available line length may not provide sufficient space for separate coil assemblies 12 and 14 as shown in FIG. 1. FIG. 2 and FIG. 3 illustrate another example of an induction heating coil assembly of the present invention wherein the advantages of both longitudinal and transverse flux induction heating can be accomplished in a single, compact coil assembly. In this arrangement, as shown in FIG. 2, the induction coil assembly 11 comprises upper coil section 15 and lower coil section 17. Upper coil section 15 has end terminals 1 and 2, and lower coil section 17 has end terminals 3 and 4.

FIG. 3 illustrates one example of a diagrammatic power supply circuit for providing induction heating current to induction coil assembly 11. In FIG. 3 the upper and lower coil sections 15 and 17 are schematically illustrated as inductive elements $L_c$. That is, upper coil section 15 is represented by inductive elements $L_c$ on either side of continuous strip 24, and lower coil section 17 is represented by inductive elements $L_c$ on either side of continuous strip 24.

Low frequency (LF) inverter 40 supplies ac current to the terminals of the upper and lower coil sections via inductive circuit elements as shown in FIG. 3. The first output terminal of LF inverter 40 is connected by inductive elements $L_1$ and $L_2$ to terminals 1 and 2 of upper coil section 15, respectively, and the second output terminal of LF inverter 40 is connected by inductive elements $L_3$ and $L_4$ to terminals 3 and 4 of lower coil section 17, respectively.

High frequency (HF) inverter 42 supplies ac current to the terminals of the upper coil section via capacitive circuit elements as shown in FIG. 3. The first output terminal of HF inverter 42 is connected by capacitive element $C_1$ to terminal 1 of upper coil section 15, and the second output terminal of HF inverter 42 is connected by capacitive element $C_2$ to terminal 2 of upper coil section 15. High frequency (HF) inverter 44 supplies ac current to the terminals of the lower coil section via capacitive circuit elements as shown in FIG. 3. The first output terminal of HF inverter 44 is connected by capacitive element $C_3$ to terminal 3 of lower coil section 17, and the second output terminal of HF inverter 44 is connected by capacitive element $C_4$ to terminal 4 of lower coil section 17.

In this non-limiting example of the invention, rectifier 46 provides dc output power to LF inverter 40 from a suitable ac source, and rectifier 48 supplies dc power from a suitable source to both HF inverters 42 and 44. The dc inputs to inverters 42 and 44 are arranged in series so that approximately one-half of the dc output voltage of rectifier 48 is applied equally across the input of the two HF inverters.

The ac current output of LF inverter 40 has a substantially lower frequency than the ac current outputs of HF inverters 42 and 44. For example, the LF inverter may operate at an output current frequency of 10 kHz and the HF inverters may operate at an output current frequency of 100 kHz. Further the ac current outputs from HF inverters 42 and 44 are of substantially equal magnitudes and 180 electrical degrees out of phase.

The capacitance of capacitive elements $C_1$, $C_2$, $C_3$ and $C_4$ is selected so that their impedance at the frequency of the substantially equal-magnitude output currents, $I_{hf}$, of HF inverters 42 and 44 is low, and the inductance of the inductive elements $L_1$, $L_2$, $L_3$ and $L_4$ is selected so that their impedance at the frequency of $I_{hf}$ is high. In this arrangement, $I_{hf}$, as indicated by the arrows in FIG. 3, flows through the upper and lower coil sections. The high impedance inductive elements block the flow of $I_{hf}$ from the ac output terminals of LF inverter 40. $I_{hf}$ creates a magnetic flux field around coils $L_c$ that is substantially directed along the longitudinal axis of continuous strip 24 and inductively heats the strip as it passes through coil heating assembly 11 substantially uniformly across its cross section.

The inductance of the inductive elements $L_1$, $L_2$, $L_3$ and $L_4$ is selected so that their impedance at the frequency of the output current, $I_{lf}$, of LF inverter 40 is low, and the capacitance of capacitive elements $C_1$, $C_2$, $C_3$ and $C_4$ is selected so that their impedance at the frequency of $I_{lf}$ is high. In this arrangement, $I_{lf}$, as indicated by the arrows in FIG. 3, flows through the upper and lower coil sections. The high impedance capactive elements block the flow of $I_{lf}$ to the ac output terminals of HF inverters 42 and 44. Current $I_{lf}$ creates a magnetic flux field around coils $L_c$ that is substantially directed along the transverse axis of continuous strip 24 and inductively heats the strip as it passes through coil heating assembly 11 non-uniformly across its cross section.

In this example of the invention, longitudinal and transverse flux field induction heating are achieved simultaneously with a single coil assembly. Control of the overall cross sectional temperature of the continuous strip as it exits induction heating coil assembly 11 can be accomplished by controlling the ac current outputs (magnitude, phase and/or frequency) of the LF and HF inverters.

Typically capacitances of all capacitive elements, $C_1$, $C_2$, $C_3$ and $C_4$, Will be the same, and the inductances of all inductive elements, $L_1$, $L_2$, $L_3$ and $L_4$, will be the same. Further the capacitances of the capacitive elements may be selected to form resonant circuits with coils $L_c$ to maximize power transfer from the HF inverters to coils $L_c$.

In all examples of the invention, rectifiers may utilize non-controllable rectification components, such as diodes. Rectifiers may also utilize controllable rectification components, such as silicon controlled rectifiers (SCR), in which case dc output control, if desired, can be achieved by control of the rectification components.

While a particular arrangement of rectifiers supplying dc power to the inverters in each example of the invention is illustrated, other arrangements of rectifiers, including different quantities and types, including single and three phase, are within the scope of the invention. Further use of either current fed or voltage fed inverters with the induction coil assemblies of the present invention is within the scope of the invention. Further the induction coil assemblies may be suitably modified by one skilled in the art for use with other types of inverter, including single and three phase, without deviating from the scope of the invention. While all coils are shown as single turn coils in the examples of the invention, coil assemblies with other number of turns and arrangements are contemplated as being within the scope of the invention. The examples of the invention include reference to specific electrical components. One skilled in the art may practice the invention by substituting components that are not necessarily of the same type but will create the desired conditions or accomplish the desired results of the invention. For example, single components may be substituted for multiple components or vice versa.

The foregoing examples do not limit the scope of the disclosed invention. The scope of the disclosed invention is further set forth in the appended claims.

What is claimed is:

1. An induction heating coil assembly for heating an electrically conductive workpiece, the induction heating coil assembly comprising:

a first coil assembly comprising first and second coil sections, each coil section comprising first and second complementary half-turns that form an effective full-turn coil through which the electrically conductive material passes, wherein the coil sections are arranged longitudinally separated from each other in the direction of the path of the electrically conductive material through the coil assembly, the first half-turn of the first coil section and the first half-turn of the second coil section being connected at their first ends by a first shunt conductor, the first end of the second half-turn of the first coil section being likewise connected at the same first end of the first coil assembly to the first end of the second half-turn of the second coil section by a second shunt conductor, the first and second shunt conductors being separated from each other by a gap of sufficient dimension to permit the electrically conductive material to be positioned in and removed from the first coil assembly edgewise through the gap thus formed in the first end of the first coil assembly, the second end of the first half-turn of the first coil section forming a first assembly terminal, the second end of the second half-turn of the first coil section forming a second assembly terminal, the second end of the first half-turn of the second coil section forming a third assembly terminal, the second end of the second half-turn of the second coil section forming a fourth assembly terminal;

a second coil assembly comprising first and second coil sections wherein the coil sections are arranged longitudinally separated from each other in the direction of the path of the electrically conductive material through the second coil assembly, the first half-turn of the first coil section and the first half-tun of the second coil section being connected at their first ends by a third shunt conductor, the first end of the second half-turn of the first coil section being likewise connected at the same first end of the second coil assembly to the first end of the second half-turn of the second coil section by a fourth shunt conductor, the third and fourth shunt conductors being separated from each other by a gap of sufficient dimension to permit the electrically conductive material to be positioned in and removed from the second coil assembly edgewise through the gap thus formed in the first end of the second coil assembly, the second end of the first half-turn of the first coil section forming a fifth assembly terminal, the second end of the second half-turn of the first coil section forming a sixth coil assembly terminal, the second end of the first half-turn of the second coil section forming a seventh assembly terminal, the second end of the second half-turn of the second coil section forming an eighth assembly terminal, the second coil assembly in tandem with the first coil assembly to allow the electrically conductive material to pass sequentially through the first and second coil assemblies;

a first inverter having a first inverter dc input and a first inverter ac output, the first inverter ac output connected across the first and second assembly terminals;

a second inverter having a second inverter dc input and a second inverter ac output, the second inverter ac output connected across the third and fourth assembly terminal, the output current of the second inverter substantially equal in magnitude and 180 electrical degrees out of phase with the output current of the first inverter;

a third inverter having a third inverter dc input and a third inverter ac output, the third inverter ac output connected across the combination of the fifth and sixth assembly terminals and the combination of the seventh and eight assembly terminals;

a first ac to dc rectifier having a first rectifier ac input connected to an ac source and a first rectifier dc output, the first rectifier dc output connected in series across the dc inputs of the first and second inverters to apply approximately one-half of the first ac to dc rectifier dc output voltage across each dc input of the first and second inverters; and a second ac to dc rectifier having a second rectifier ac input connected to the ac source and a second rectifier dc output, the second rectifier dc output connected across the dc input of the third inverter.

2. The induction heating coil assembly of claim 1 wherein the first and second ac to dc rectifiers comprise a single ac to dc rectifier.

3. The induction heating coil assembly of claim 1 further comprising a means for controlling the ac output currents of the first and second inverters to substantially control overall cross sectional induction heating of the electrically conductive workpiece and a means for controlling the ac output current of the third inverter to substantially control edge induction heating of the electrically conductive workpiece.

4. A method of inductively heating an electrically conductive workpiece, the method comprising the steps of:

sequentially passing the electrically conductive material through a transverse flux induction coil and a longitudinal flux induction coil, the transverse flux induction coil comprising first and second coil sections wherein the coil sections are arranged longitudinally separated from each other in the direction of the path of the electrically conductive material through the transverse flux induction coil, the first half-turn of the first coil section and the first half-turn of the second coil section being connected at their first ends by a first shunt conductor, the first end of the second half-turn of the first coil section being likewise connected at the same first end of the transverse flux induction coil to the first end of the second half-turn of the second coil section by a second shunt conductor, the first and second shunt conductors being separated from each other by a gap of sufficient dimension to permit the electrically conductive material to be positioned in and removed from the transverse flux induction coil edgewise through the gap thus formed in the first end of the transverse flux induction coil, the second end of the first half-turn of the first coil section forming a first assembly terminal, the second end of the second half-turn of the first coil section forming a second assembly terminal, the second end of the first half-turn of the second coil section forming a third assembly terminal, the second end of the second half-turn of the second coil section forming a fourth assembly terminal, and the longitudinal flux induction coil comprising first and second coil sections, each coil section comprising first and second complementary half-turns that form an effective full-turn coil through which the electrically conductive material passes, wherein the coil sections are arranged longitudinally separated from each other in the direction of the path of the electrically conductive material through the longitudinal flux induction coil, the first half-turn of the first coil section and the first half-turn of the second coil section being connected at their first ends by a third shunt conductor, the first end of the second half-turn of the first coil section being likewise connected at the same first end of the first coil assembly to the first end of the second half-turn of the second coil section by a fourth shunt conductor, the third and fourth shunt conductors being separated from each other by a gap of sufficient dimension to permit the electrically conductive material to be positioned in and removed from the longitudinal flux induction coil edgewise through the gap thus formed in the first end of the longitudinal flux induction coil, the second end of the first half-turn of the first coil section forming a fifth assembly terminal, the second end of the second half-turn of the first coil section forming a sixth assembly terminal, the second end of the first half-turn of the second coil section forming a seventh assembly terminal, the second end of the second half-turn of the second coil section forming an eighth assembly terminal;

supplying a source of a first ac current between the combination of the first and second assembly terminals and the third and fourth assembly terminals from a first inverter;

supplying a source of a second ac current from a second inverter between the fifth and sixth assembly terminals;

supplying a source of a third ac current from a third inverter between the seventh and eighth assembly terminals, the third ac current substantially equal in magnitude and 180 electrical degrees out of phase with the second ac current;

supplying a source of a first dc current from a first rectifier to the input of the first inverter;

supplying a source of a second dc current from a second rectifier between series connected inputs of the second and third inverters with approximately one-half of the rectifier dc output voltage across the input of the first inverter and the input of the second inverter;

adjusting the first ac current to substantially change the level of edge induction heating of the electrically conductive workpiece; and adjusting the second and third ac currents to substantially change the overall cross sectional induction heating of the electrically conductive workpiece.

5. An induction heating coil assembly for heating an electrically conductive workpiece, the induction heating coil assembly comprising:

a first coil assembly comprising a longitudinal flux induction coil having first and second assembly terminals;

a second coil assembly comprising first and second coil sections wherein the coil sections are arranged longitudinally separated from each other in the direction of the path of the electrically conductive material through the second coil assembly, the first half-turn of the first coil section and the first half-turn of the second coil section being connected at their first ends by a first shunt conductor, the first end of the second half-turn of the first coil section being likewise connected at the same first end of the second coil assembly to the first end of the second half-turn of the second coil section by a second shunt conductor, the first and second shunt conductors being separated from each other by a gap of sufficient dimension to permit the electrically conductive material to be positioned in and removed from the second coil assembly edgewise through the gap thus formed in the first end of the second coil assembly, the second end of the first half-turn of the first coil section forming a third assembly terminal, the second end of the second half-turn of the first coil section forming a fourth assembly terminal, the second end of the first half-turn of the second coil section forming a fifth assembly terminal, the second end of the second half-turn of the second coil section forming a sixth assembly terminal, the second coil assembly in tandem with the first coil assembly to allow the electrically conductive material to pass sequentially through the first and second coil assemblies;

a first inverter having a first inverter dc input and a first inverter ac output, the first inverter ac output connected across the first and second assembly terminals;

a second inverter having a second inverter dc input and a second inverter ac output, the second inverter ac output connected across the combination of the third and fourth assembly terminals and the combination of the fifth and sixth assembly terminals;

a first ac to dc rectifier having a first rectifier ac input connected to an ac source and a first rectifier dc output, the first rectifier dc output connected across de input of the first inverter; and a second ac to dc rectifier having a second rectifier ac input connected to an ac source and a second rectifier dc output, the second rectifier dc output connected across the dc input of the second inverter.

6. The induction heating coil assembly of claim 5 wherein the first and second ac to dc rectifier comprise a single ac to dc rectifier.

7. The induction heating coil assembly of claim 5 further comprising a means for controlling the ac output current of the first inverter to substantially control the level of overall cross sectional induction heating of the electrically conductive workpiece, and a means for controlling the ac output current of the second inverter to substantially control edge induction heating of the electrically conductive workpiece.

8. A method of inductively heating an electrically conductive workpiece, the method comprising the steps of:

sequentially passing the electrically conductive material through a transverse flux induction coil and a longitudinal flux induction coil, the transverse flux induction coil comprising first and second coil sections wherein the coil sections are arranged longitudinally separated from each other in the direction of the path of the electrically conductive material through the transverse flux induction coil, the first half-turn of the first coil section and the first half-turn of the second coil section being connected at their first ends by a first shunt conductor, the first end of the second half-turn of the first coil section being likewise connected at the same first end of the transverse flux induction coil to the first end of the second half-turn of the second coil section by a second shunt conductor, the first and second shunt conductors being separated from each other by a gap of sufficient dimension to permit the electrically conductive material to be positioned in and removed from the transverse flux induction coil edgewise through the gap thus formed in the first end of the transverse flux induction coil, the second end of the first half-turn of the first coil section forming a first assembly terminal, the second end of the second half-turn of the first coil section forming a second assembly terminal, the second end of the first half-turn of the second coil section forming a third assembly terminal, the second end of the second half-turn of the second coil section forming a fourth assembly terminal, and the longitudinal flux induction coil having a fifth and sixth assembly terminals;

supplying a source of a first ac current between the combination of the first and second assembly terminals and the third and fourth assembly terminals from a first inverter;

supplying a source of a second ac current from a second inverter between the fifth and sixth assembly terminals;

supplying a source of a first de current from a first rectifier to the input of the first inverter;

supplying a source of a second dc current from a second rectifier to the input of the second inverter;

adjusting the first ac current to substantially change the level of edge induction heating of the electrically conductive workpiece; and adjusting the second ac current to substantially change the overall cross sectional induction heating of the electrically conductive workpiece.

9. An induction heating coil assembly for heating an electrically conductive workpiece, the induction heating coil assembly comprising:

a coil assembly comprising first and second coil sections, each coil section comprising first and second complementary half-turns that form an effective full-turn coil through which the electrically conductive material passes, wherein the coil sections are arranged longitudinally separated from each other in the direction of the path of the electrically conductive material through the apparatus, the first half-turn of the first coil section and the first half-turn of the second coil section being connected at their first ends by a first shunt conductor, the first end of the second half-turn of the first coil section being likewise connected at the same first end of the first coil assembly to the first end of the second half-turn of the second coil section by a second shunt conductor, the shunt conductors being separated from each other by a gap of sufficient dimension to permit the electrically conductive material to be positioned in and removed from the coil assembly edgewise through the gap thus formed in the one end of the first coil assembly, the second end of the first half-turn of the first coil section forming a first assembly terminal, the second end of the second half-turn of the first coil section forming a second assembly terminal, the second end of the first half-turn of the second coil section forming a third assembly terminal, the second end of the second half-turn of the second coil section forming a fourth assembly terminal;

a first capacitance element having first and second terminals;

a first inductive element having first and second terminals, the first terminals of the first capacitance and first inductive element connected together and connected to the first assembly terminal;

a second capacitive element having first and second terminals;

a second inductive element having first and second terminals, the first terminals of the second capacitive element and second inductive element connected together and connected to the second assembly terminal;

a third capacitive element having first and second terminals;

a third inductive element having first and second terminals, the first terminals of the third capacitive element and third inductive element connected together and connected to the third assembly terminal;

a fourth capacitive element having first and second terminals;

a fourth inductive element having first and second terminals, the first terminals of the fourth capacitive element and fourth inductive element connected together and connected to the fourth assembly terminal;

a first inverter having a first inverter dc input and a first inverter ac output, the first inverter ac output connected across the second terminal of the first capacitive element and the second terminal of the second capacitive element;

a second inverter having a second inverter dc input and a second inverter ac output, the second inverter ac output connected across the second terminal of the third capacitive element and the second terminal of the fourth capacitive element; the ac output current of the second inverter substantially equal in magnitude and 180 electrical degrees out of phase with the ac output current of the first inverter;

a third inverter having a third inverter dc input and a third inverter ac output, the third inverter ac output connected across the combination of the second terminals of the first and second inductive elements and the combination of the second terminals of the third and fourth inductive elements, the first and second inverters having an output frequency greater than the output frequency of the third inverter;

a first ac to dc rectifier having a first rectifier ac input connected to an ac source and a first rectifier dc output, the output of the first ac to dc rectifier connected in series across the dc inputs of the first and second inverters; and a second ac to dc rectifier having a second rectifier ac input connected to an ac source and a second rectifier dc output, the output of the second ac to dc rectifier connected across the dc input of the third inverter; whereby the first, second, third and fourth inductive elements block the flow of the ac output current from the first and second inverters to the ac output of the third inverter, and the first, second, third and fourth capacitive elements block the flow of the ac output current from the third inverter to the ac input of the first and second inverters.

10. The induction heating coil assembly of claim 9 wherein the first and second ac to dc rectifier comprise a single ac to dc rectifier.

11. The induction heating coil assembly of claim 9 further comprising a means for controlling in combination the ac output currents of the first and second inverters, and the third inverter to selectively control the overall and edge cross sectional induction heating of the electrically conductive workpiece.

12. A method of inductively heating an electrically conductive workpiece, the method comprising the steps of:

passing the electrically conductive material through an induction heating coil assembly comprising first and second coil sections wherein the coil sections are arranged longitudinally separated from each other in the direction of the path of the electrically conductive material through the induction heating coil assembly, the first half-turn of the first coil section and the first half-turn of the second coil section being connected at their first ends by a first shunt conductor, the first end of the second half-turn of the first coil section being likewise connected at the same first end of the second coil assembly to the first end of the second half-turn of the second coil section by a second shunt conductor, the first and second shunt conductors being separated from each other by a gap of sufficient dimension to permit the electrically conductive material to be positioned in and removed from the induction heating coil assembly edgewise through the gap thus formed in the first end of the induction heating coil assembly, the second end of the first half-turn of the first coil section forming a first assembly terminal, the second end of the second half-turn of the first coil section forming a second assembly terminal, the second end of the first half-turn of the second coil section forming a third assembly terminal, the second end of the second half-turn of the second coil section forming a fourth assembly terminal, supplying a first ac current from a first inverter between the first and second assembly terminals via a first and second capacitive elements;

supplying a second ac current from a second inverter between the third and fourth assembly terminals via a third and fourth capacitive elements, the second ac current substantially equal in magnitude and 180 electrical degrees out of phase with the first ac current;

supplying a third ac current from a third inverter between the combination of the first and second assembly terminals and the combination of the third and fourth assembly terminals, the frequency of the ac outputs of the first and second inverters greater than the frequency of the ac output of the third inverter, the first and second capacitive elements blocking the third ac current from the ac output of the first inverter, the third and fourth capacitive elements blocking the third ac current form the ac output of the second inverter, and the first, second, third and fourth inductive elements blocking the first and second ac currents from the ac input of the third inverter;

supplying a source of a first dc current from a first rectifier between series connected inputs of the first and second inverters with approximately one-half of the dc output voltage from the first rectifier across each dc input of the second inverters;

supplying a source of a second dc current from a second rectifier to the dc input of the third inverter;

adjusting the first and second ac inverter currents to substantially change the overall level of cross sectional inducing heating of the electrically conductive workpiece; and adjusting the third ac inverter current to substantially change the edge induction heating of the electrical conductive workpiece.

* * * * *